US006186841B1

(12) United States Patent
Jacobsson

(10) Patent No.: US 6,186,841 B1
(45) Date of Patent: Feb. 13, 2001

(54) CONTACT SLEEVE FOR ELECTRICAL COMMUNICATION

(75) Inventor: Jan Jacobsson, Vingaker (SE)

(73) Assignee: FCI Katrineholm A.B., Katrineholm (SE)

( * ) Notice: Under 35 U.S.C. 154(b), the term of this patent shall be extended for 0 days.

(21) Appl. No.: 09/538,210

(22) Filed: Mar. 30, 2000

(30) Foreign Application Priority Data

Mar. 31, 1999 (SE) ..... 9901181

(51) Int. Cl.[7] ..... H01R 11/22
(52) U.S. Cl. ..... 439/851; 439/857; 439/856
(58) Field of Search ..... 439/851, 852, 439/842, 843, 846, 856, 857, 924.1

(56) References Cited

U.S. PATENT DOCUMENTS

| | | | | |
|---|---|---|---|---|
| 4,002,400 | | 1/1977 | Evans | 339/258 R |
| 4,232,931 | | 11/1980 | Takeuchi et al. | 339/258 R |
| 4,666,227 | * | 5/1987 | Galizia et al. | 439/252 |
| 4,722,704 | | 2/1988 | VanDerStuyf et al. | 439/851 |
| 4,902,249 | | 2/1990 | Morishita et al. | 439/610 |
| 4,906,212 | * | 3/1990 | Mixon, Jr. | 439/857 |
| 5,494,463 | | 2/1996 | Nishio et al. | 439/181 |
| 5,591,039 | | 1/1997 | Matthews | 439/181 |
| 5,667,413 | * | 9/1997 | Trafton | 439/854 |

FOREIGN PATENT DOCUMENTS

| | | | | |
|---|---|---|---|---|
| 403291874 | * | 12/1991 | (JP) | 439/843 |
| WO 98/06150 | | 2/1998 | (WO) . | |

* cited by examiner

*Primary Examiner*—Paula Bradley
*Assistant Examiner*—Tho D. Ta
(74) *Attorney, Agent, or Firm*—Perman & Green, LLP

(57) ABSTRACT

A contact sleeve (3) comprising a first end (6) for electrical communication with a conductor means (7), a fastening portion (9) at a central part (11) of said contact sleeve (3) and a second end (12) comprising a plurality of contact beams (13) with inner contact surfaces (14) projecting longitudinally from said central part (11) arranged generally cylindrically around a longitudinal axis (A—A) of said contact sleeve (3) adapted for electrical communication with a corresponding mating pin (15) provided with a rounded top (17). Said plurality of contact beams (13) comprises at least three first contact beams (19*a*) and at least one second contact beam (20) being inwardly bent in direction to said axis (A—A) of said contact sleeve (3), said first contact beams (19*a*) relative to said at least one second contact beam (20) are more inwardly bent for making a first electrical contact with said corresponding mating pin (15) at the beginning of a mating cycle and said at least one second contact beam (20) makes a contact with said mating pin (15) after that said at least three first contact beams (19*a*) are in contact with said mating pin (15).

10 Claims, 7 Drawing Sheets

C-C

C-C

CONTACT SLEEVE FOR ELECTRICAL COMMUNICATION

TECHNICAL FIELD OF THE INVENTION

Figure 1A:
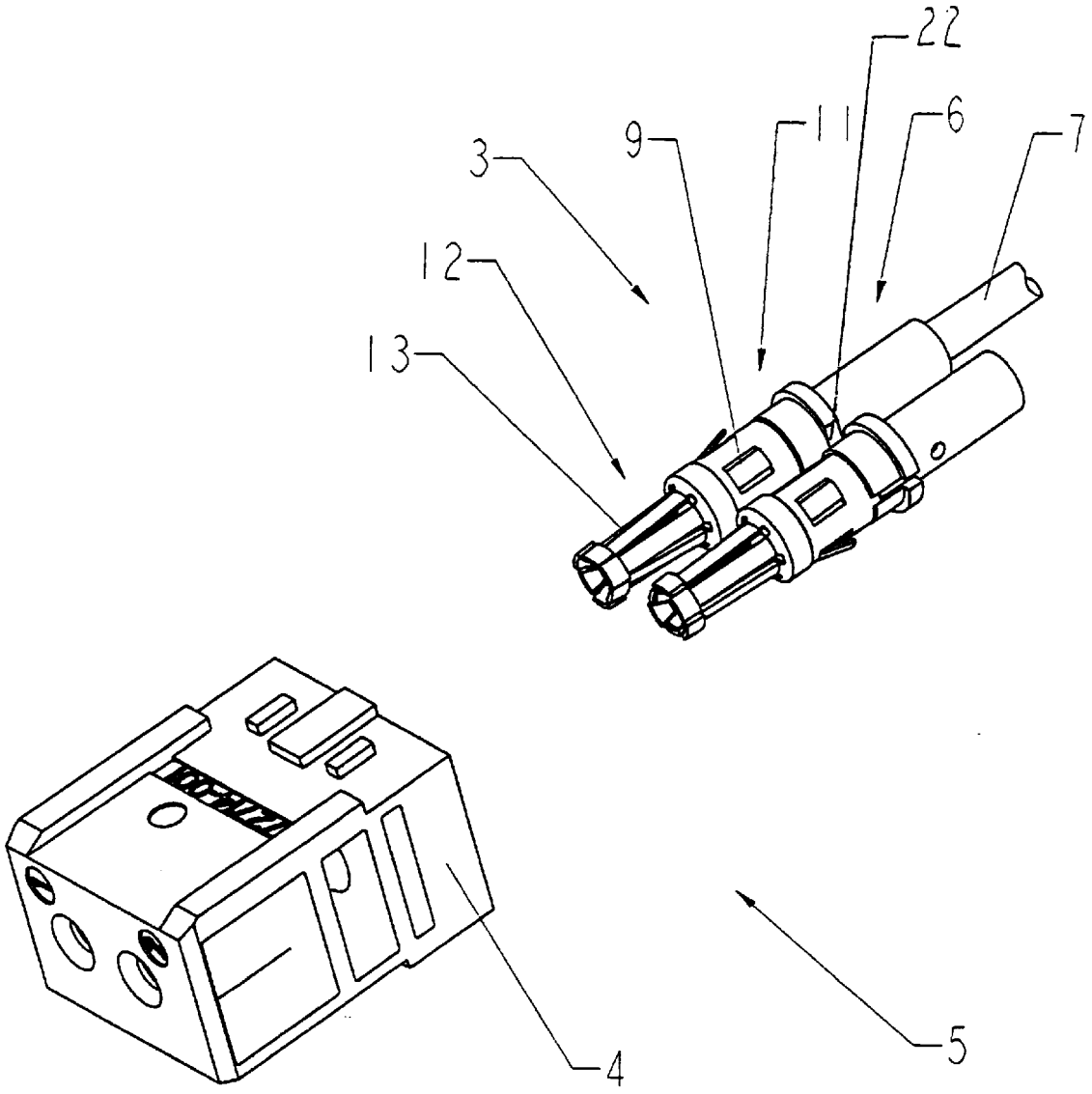

The present invention relates to a connector, in accordance with the preamble of claim 1.

Known contact sleeves, as, for example, the one disclosed in U.S. Pat. No. 4,902,249, suffers from the disadvantage that an initial surge of high current is anticipated to disrupt the plating of the contact sleeve during the beginning of the mating cycle with a mating pin, which disruption in a plugged state makes a not satisfactory contact for electrical communication between the contact sleeve and the mating pin.

The connector and its contact sleeve according to the one disclosed in U.S. Pat. No. 4,902,249 have a plurality of contact beams arranged around the mating pin, which pin in a plugged state is in contact with two circular working contact surfaces of the sleeve, one in the outer contact portion and one in the inner contact portion of the contact sleeve.

The problem here, according to known technique, is that during the beginning of the mating cycle the mating pin will have contact with the outer contact portion of the contact sleeve causing an initial surge of high current disrupting the outer end of the contact sleeve, that is in the area of the outer contact portion of the contact sleeve, and also disrupting the end of the mating pin This means that the contact between the sleeve and the contact pin in the area of the outer portion of the sleeve is deteriorated for electrical communication. That means that a decay sequence is developed and that an adulteration of for example the contact resistance and the current carrying capacity. Also a corrosion due to the damaged plating of respectively the end of the mating pin and the outer contact portion cause a deteriorated capacity for electrical communication.

Known contact sleeves, as, for example, the one disclosed in U.S. Pat. No. 4,902,249, means furthermore that when the plating of the outer contact portion of the sleeve, or the contact sleeve material itself, once for all is destroyed, the damaged area will cause an effect on the mating pin over all its area. Primary, when the pin is in a plugged state and the outer contact portion of the contact sleeve has its contact area corresponding to the area of an inner contact portion of the mating pin, there is a risk that the decayed outer contact portion of the sleeve will cause a damage to the above mentioned corresponding inner area of the mating pin.

To solve this problem with the disruptive contact surfaces, when plugging known contact sleeves to mating pins, mounted in a power terminal, instructions to service personnel have been provided, in form of manuals and information tables, that is instructions to switch off the power circuit before plugging the power terminal into for example a circuit card. The result of this step, is that service personnel, even if they are restrictive obliged to follow those manuals, when being pressed for short of time or other circumstances, not follow the instructions.

Even though the power circuit has been switched off, an electrical charge can be detained in the circuit and therefor also cause a initial surge of high current between the mating pin and the contact sleeve disrupting the plating of the contact beams.

That means that the contact sleeves gradual will be damaged at their contact surfaces. This results in high operating costs, since the power terminals frequently have to be replaced. Also malfunctions may come into existence within the circuit card caused by the deteriorated contact functions, causing high costs.

It is, accordingly, an object of the invention to overcome the disadvantages of the known devices. That is, primary, to provide a measure contributory towards a sound mateable power connection without any deteriorated contact functions and that service personnel do not have to switch of the power circuit before a plug in.

Making the contact sleeves non-rotatable in a housing forming for example a power terminal is desirable, since disparate position of the contact beams means that the mating pin would have different contact positions with the contact beams each time they are plugged. To solve this problem with rotatable contact sleeves when mounted in a housing forming for example a power terminal, the inventor of this invention has provided the contact sleeves with a chamfering at a central part of the contact sleeve. This chamfering provides a fixing of the contact sleeves by means of a partition of the housing, which partition also provides a distance between the contact sleeves when mounted in the housing.

SUMMARY OF THE INVENTION

The above mentioned objects have been solved by a contact sleeve as defined in the introduction, which is characterized in that the plurality of contact beams comprises at least three first contact beams and at least one second contact beam being inwardly bent in direction to the axis (A—A) of the contact sleeve, the first contact beams relative to the at least one second contact beam are more inwardly bent for making a first electrical contact with the corresponding mating pin at the beginning of a mating cycle and the at least one second contact beam makes a contact with the mating pin after that the at least three first contact beams are in contact with the mating pin.

Hereby, the at least three first contact beams provide a means for uptaking an initial surge of high current. The at least three first contacts which are bent inwards will further on also be called live contacts. The ends of the live contacts will be exposed to disruptive discharge, which was the intention of the inventor of this invention. Subsequently the contact sleeve can be mounted in a housing forming a power terminal. When the mating pin is fully plugged in the contact sleeve, that is in a position for operation, the at least one second contact beam provide the contact function together with the live contacts. The at least one second contact beam will further on be called virgin contact/contacts. The virgin contact/contacts make/makes contact with the mating pin, after that the live contacts had their contact with the mating pin being exposed for disruptive discharge.

Preferably, the at least three first contact beams and the at least one second contact beam have essentially the same length. In this way the area of the rounded top of the mating pin, first will have contact with the live contacts, since the live contacts are more inwardly bent relative to the virgin contact/contacts. The sleeve may be manufactured, by an automatic lathe, and furthermore milled slots can be provided at the end of the sleeve, forming the contact beams, which are inwardly bent for example by means of heat treatment process, and furthermnore, according to the invention, the live contacts are more inwardly bent than the virgin contact/contacts. It is preferable to produce the contact sleeve by means of a turning lathe and a milling making slots forming the contact beams, since a high tolerance of the distribution of the contact beams can be achieved, seen in a circular cross section of the sleeve, can be provided during the manufacturing process.

Suitably, the at least three first contact beams ends further than the at least one second contact beam in the longitudinal direction of the contact sleeve for making a first electrical contact with the corresponding mating pin at the beginning of a mating cycle. Hereby a mating pin with a blunt top can be used. The longer live contacts relatively the virgin contact/contacts will have contact with the mating pin before a contact with the virgin contact/contacts is established and therefore an initial surge of high current will occur between the mating pin and the live contacts. Subsequently, when using a mating pin with a rounded top, the top at the beginning of a mating cycle, will have contact for electrical communication with the live contacts at a distance from the virgin contact/contacts fully assured that an initial surge of high current would be disrupting the plating of the end of the virgin contacts.

Preferably, the at least three first contact beams are equally disposed around the axis (A—A). Thereby can during the beginning of a mating cycle the mating pin have an impact between the live contacts in a self-centering manner and with an uniform force distribution.

Suitably, the at least three first contact beams and the at least one second contact beam in a plugged state are spring-loaded for making a contact with the corresponding mating pin. In this way a satisfactory uniform contact for electrical communication is provided between the contact beams and the mating pin by means of the beams with their contact surfaces springing in direction inwardly towards the mating pin. Subsequently a base, at the central part of the sleeve, from which base the beams extend, and which base is provided with an inner diameter, seen in a circular cross section of the sleeve, which diameter substantially corresponds to the outer diameter of the mating pin. This means that the beams in a springing state, when the mating pin is in its operative position, has a substantially cylindrical formed space corresponding to the body of the mating pin. The base, at the central part of the sleeve, may have a larger inner diameter than the outer diameter of the mating pin. This means that the beams, in a springing state when the mating pin is in its operative position, just have their outer ends against the mating pin. Thereby no contact between a major area of the mating pin and the contact sleeve has to come in existence during the mating cycle. This means that the plating of the pin firther not will be damaged.

Preferably, the contact beams each comprises a bevel for uptaking the rounded top of the mating pin at the beginning of a mating cycle. Hereby the mating pin can be mounted in a smooth and directed way, without any sharp edges damaging the top of the mating pin. Primary will also the initial surge of high current be anticipated within the area of the bevels. This means that it is the bevels of the live contact beams itself, which will be disrupted. This is an advantage since the bevels not are, when the mating pin is plugged, in direct contact with the mating pin, which provides a maximum contact condition for electrical condition between the contact beams and the mating pin. Furthermore the bevels of the live contact beams do not have any contact with the surface of the mating pin during the fully mating cycle.

Suitably, the at least three first contact beams each are made more narrow than the at least one second contact beam making a lesser spring-load on the pin. It is thereby made possibly to provide the live contact beams having smaller springing forces at the mating pin. This results in a low plug in force for the service personnel, since the more inwardly bent live contact beams can be formed with a narrower width or thickness. This provides a lesser spring-load of the live contacts towards the mating pin. Furthermore the eventually damaged plating of the contact surface of the live contact beams, have lesser influence on the plating of the mating pin, since the spring-load in this way can be reduced.

Preferably, the central part is provided with a bore having an axis which corresponds with the axis (A—A) of the contact sleeve, the bore has a further extension than the inner contact surfaces of the plurality of contact beams equivalent to a portion of the top of the mating pin. Subsequently, an extended mating pin with its rounded or blunted top, which top will have disrupted plating due to the uptaking ends of the live contact beams and the initial surge anticipated at the beginning of the mating cycle, can therefore find room for its top in the bore provided as an extension of the cylindrical inner space towards the central part formed by the contact beams. Therefore this area of the mating pin with lesser electrical communication capacity will be located in the bore when plugged.

Suitably, three second contact beams are arranged at the contact sleeve. It is thereby made possibly to provide an even and uniform spring-load of the virgin contact beams. Furthermore the fully mating cycle can be provided in a self-centering manner. Alternating the live contact beams with the virgin contact beams provides an easy and not expensive manufacturing of the contact sleeve.

Preferably, a chamfering is provided at the central part for preventing the contact sleeve to rotate together with the connected conductor in a housing comprising a partition. Hereby is prevented that the contact sleeve can be able to rotate, caused by a twisting moment of a conductor and at the same time the partition in the house provides a distance between the contact sleeves mounted in the housing.

DRAWING SUMMARY

Figure 1B:
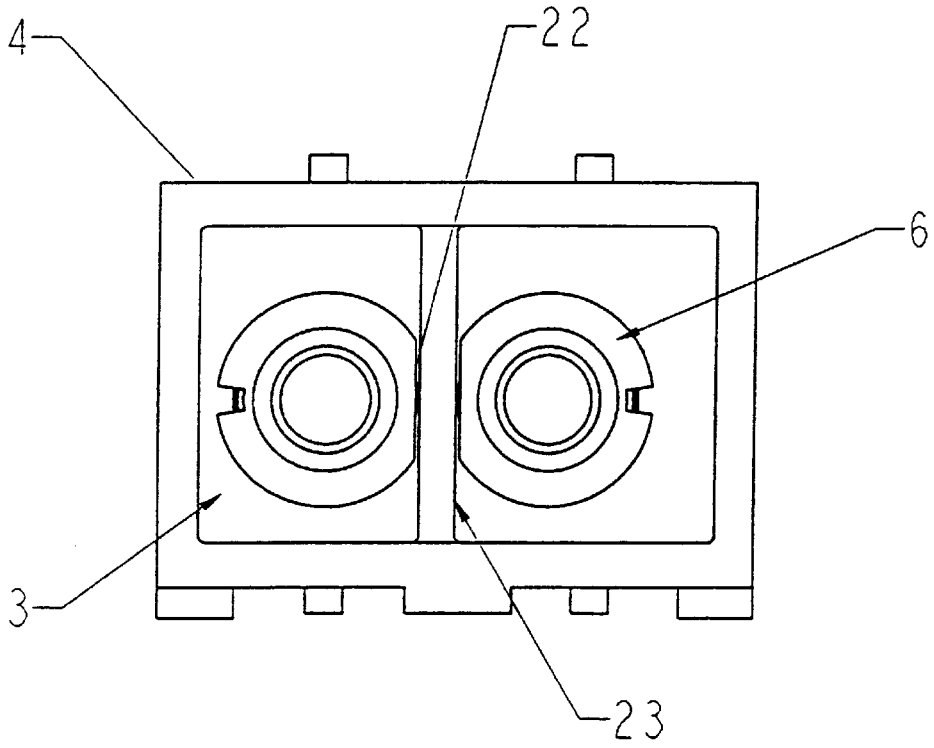
Figure 2:
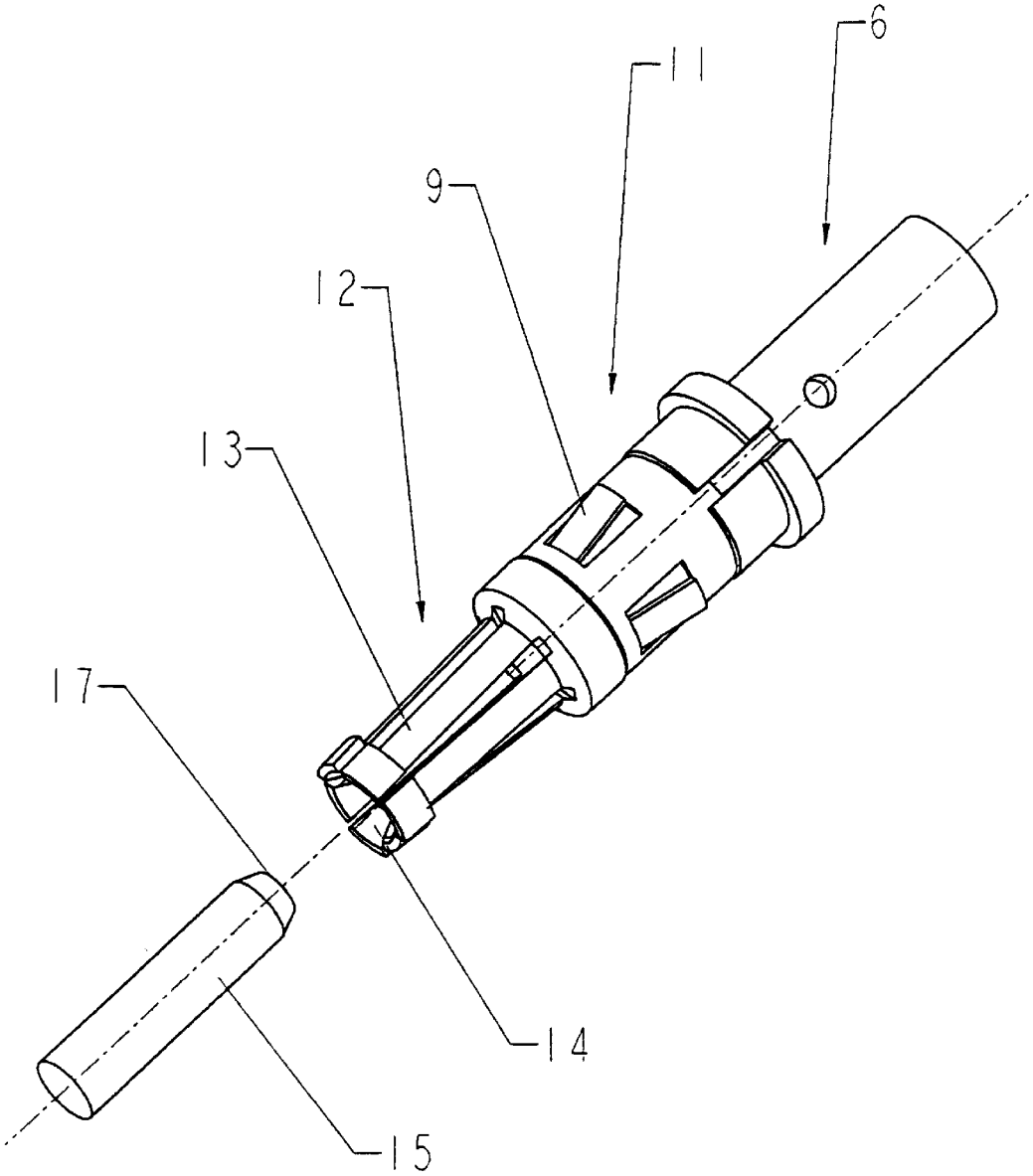
Figure 3:
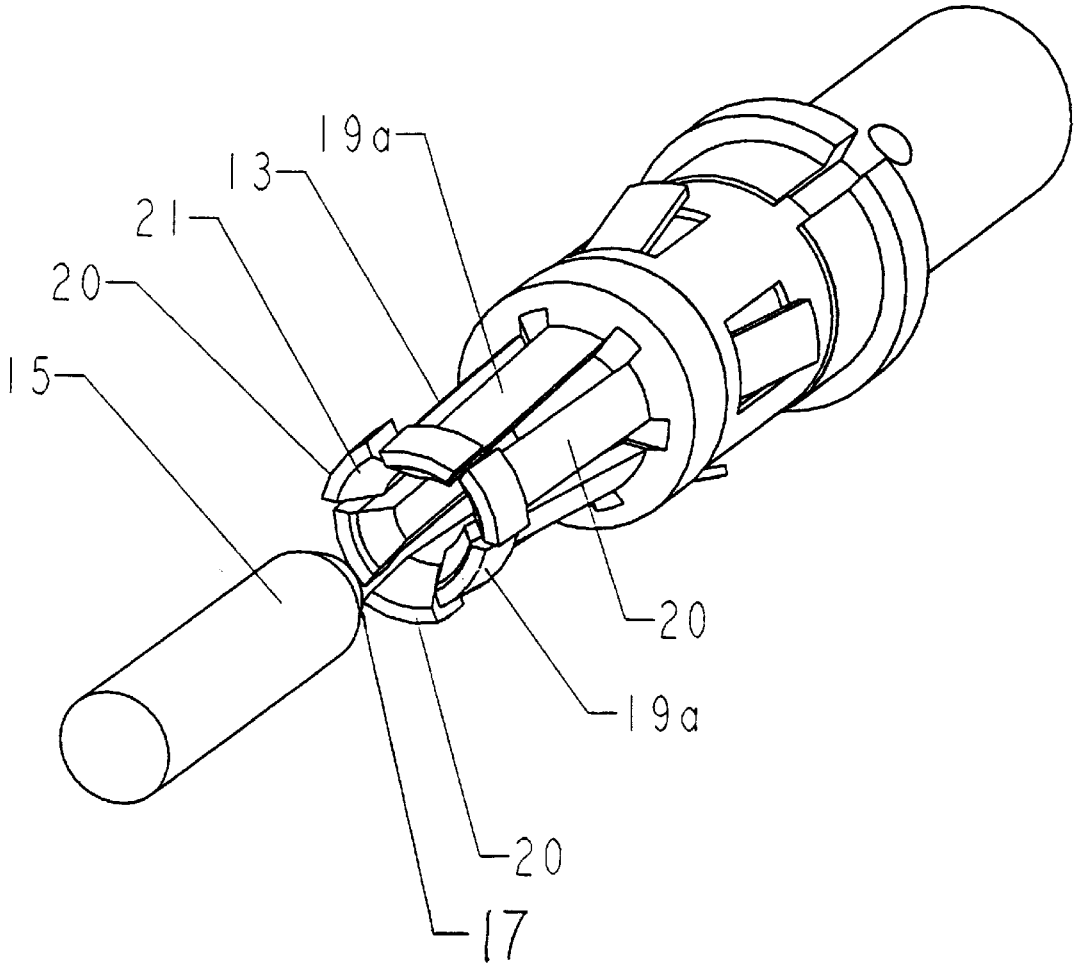
Figure 4:
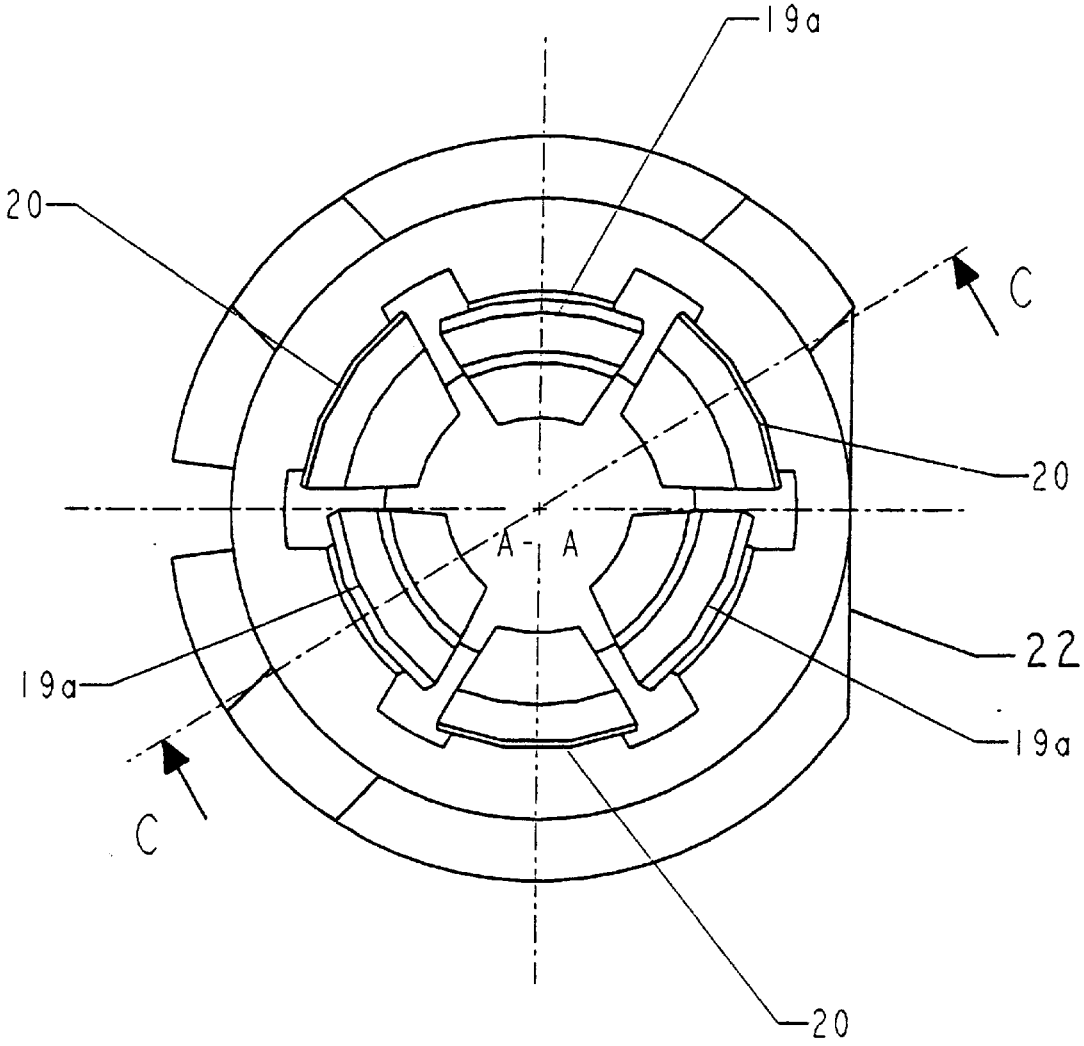
Figure 5:
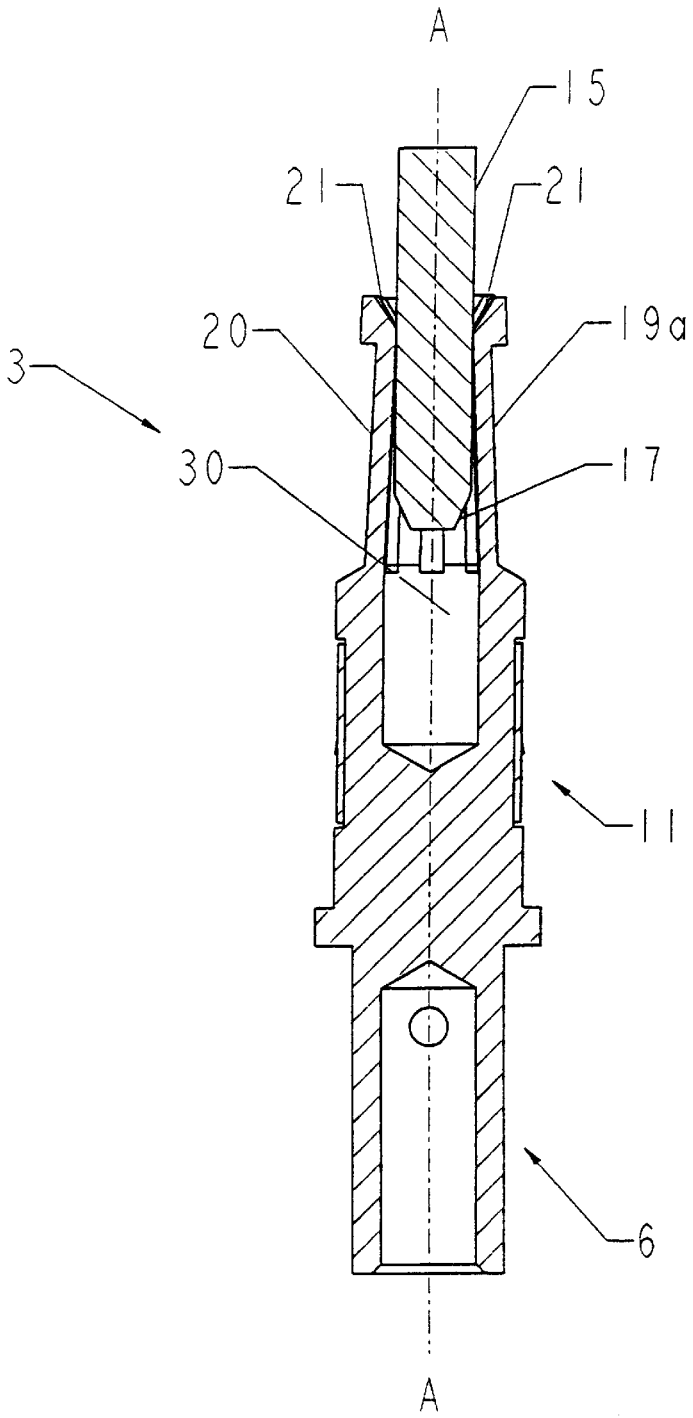
Figure 6:
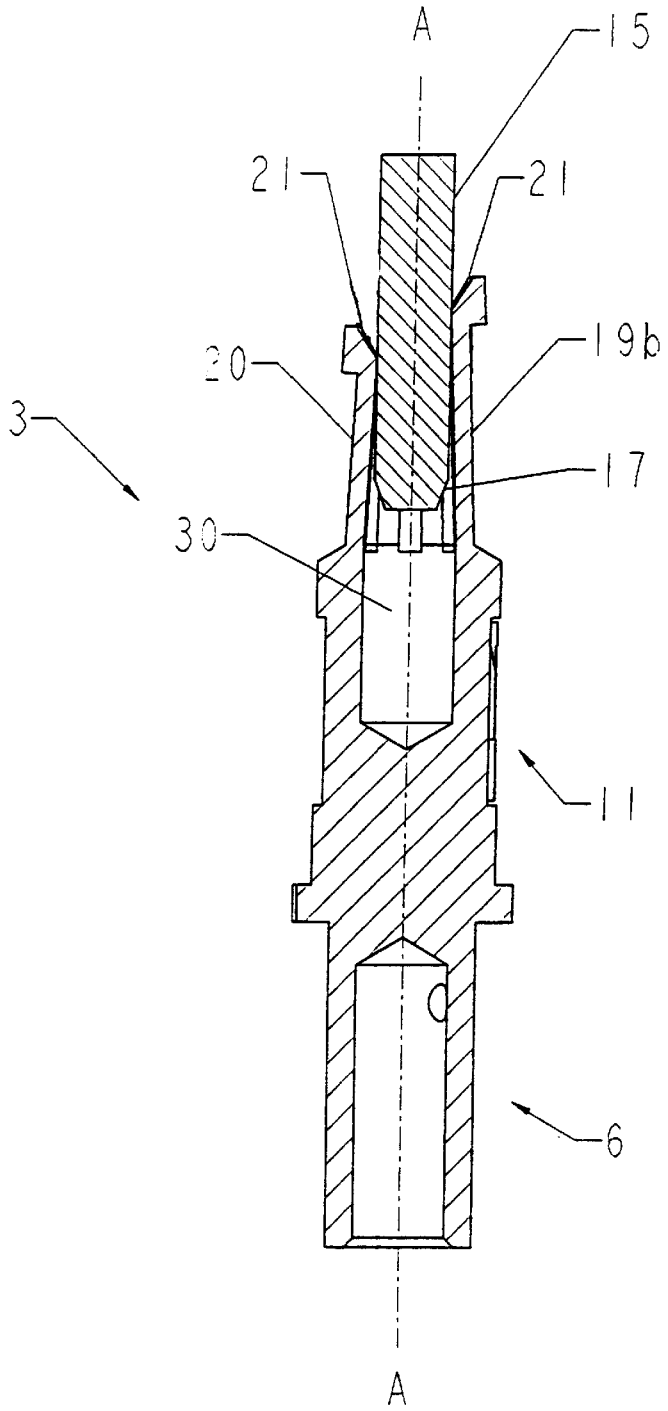

The invention will now be described more closely by means of examples of two embodiments with reference to the accompanying drawings, in which FIG. 1*a* illustrates in a view of perspective contact sleeves according to a first embodiment of the invention and its power terminal house, FIG. 1*b* illustrates a front view of a power terminal house with two mounted contact sleeves, FIG. 2 illustrates in a view of perspective the contact sleeve according to the first embodiment of the invention and a part of an mating pin, FIG. 3 illustrates an enlarged view of the contact sleeve in FIG. 2 and a corresponding mating pin, FIG. 4 illustrates a front view of the contact sleeve in FIG. 3 seen in direction from the mating pin, FIG. 5 illustrates a cross section of the contact sleeve in FIG. 4 with a plugged mating pin, and FIG. 6 illustrates a cross section of a contact sleeve according to a second embodiment of the invention.

DETAILED DESCRIPTION OF THE INVENTION

Referring to FIGS. 1*a,* 1*b,* 2, 3, 4 and 5 a contact sleeve 3, according to a first embodiment of the invention, being mechanically connectable to a housing 4, forming a power terminal 5. Parts of the power terminal 5 which are not relevant for the present invention have been omitted from the figures for the sake of clarity of illustration.

FIG. 1*b* shows a first end 6 of the contact sleeves 3 mounted in the housing 4. The solution of making a space between the two contact sleeves 3 by means of a partition 23 for making the two contact sleeves not to disrupt each other for electrical communication. At the same time a chamfering 22 provided at the central part of the contact sleeve 3 provides a fixing of the contact sleeve 3 by means of the partition 23 in the housing 4 when the contact sleeves are mounted in the housing 4. This provides that the contact sleeves 3 are non-rotatable and positioned at a distance from each other far enough without causing any electrical disturbances between the contact sleeves 3.

The contact sleeve 3 comprises a first end 6, a central part 11 and a second end 12. The first end 6 is crimped onto a conductor 7 for electrical communication. The central part comprises a fastening portion 9, such as springing members for mechanically locking in the house 4. The second end 12 comprises a plurality of contact beams 13 with a inner plating 14, which advantageous can be provided all over the contact sleeve 3. The contact beams are substantially longitudinally extended from the central part 11 around a longitudinal axis A—A (shown in FIG. 2).

A mating pin 15 with a rounded top 17 is schematically illustrated in FIGS. 2, 3 and 5 according to the first embodiment of the invention. The mating pin will be plugged along the axis A—A. As seen in FIGS. 1*a* and 2, the contact beams 13 are inwardly bent towards the axis A—A.

In FIG. 3 are schematically illustrated specific more inwardly bent contact beams 19*a*, which will have a first contact with the rounded top 17 of the mating pin 15. Those contact beams 19*a* are further on called live contacts with the same reference sign. So called virgin contacts 20, that is, less inwardly bent contact beams 20 than the live contacts 19*a*, will have contact for electrical communication with the mating pin 15 after that an initial surge of high current has come into existence between the mating pin 15 and the live contacts 19*a* at the beginning of a mating cycle. In the first embodiment of the invention the live contacts 19*a* and the virgin contacts 20 will have essentially the same length.

Bevels 21 are provided at the end of the contact beams 13 for uptaking the rounded top 17 during the mating cycle. It is accordingly to the invention the bevels 21 of the live contacts 19*a* which will have disrupted plating 14 caused by the initial surge of high current at the beginning of the mating cycle.

FIG. 4 shows a front view of the contact sleeve 3 seen in the direction from the mating pin 15. Here is clearly shown that the contact beams 13 are equally disposed around the axis A—A (shown in the figure as a cross). It is here also illustrated that the live contacts 19*a* are more inwardly bent than the live contacts 20. The number of live contacts 19*a* is three according to the figures, since during the beginning of a mating cycle the mating pin 15 will have an impact between the live contacts in a self-centering manner and with an uniform force distribution, which is not the case using two or four contact beams. Since the number of live contacts is three, suitably the number of virgin contacts 20 also is three, since a self-centering hereby is achieved during the further mating cycle. This also permit an easy and not expensive manufacturing of the contact sleeve.

FIG. 5 is shows a cross section C—C of the contact sleeve in FIG. 4. FIG. 5 shows schematically a plugged state of the mating pin 15, wherein the mating pin 15 has its operative position in the contact sleeve 3. The live contacts 19*a* and the virgin contacts 20 are in FIG. 5 in a spring-loaded condition for making a contact with the mating pin 15. In FIG. 5 furthermore is shown a bore 30 provided for uptaking the rounded top 17 of the mating pin 15. Also a blunted top (not shown) of the mating pin 15 would have room in the bore 30. In this way the area of the top 17 with less electrical contact capacity can be located in the bore 30 in a plugged state.

FIG. 6 shows an example of a second embodiment of the invention, in which parts denoted with a reference sign correspond to parts of the first embodiment with the same reference sign. In this second embodiment the live contacts 19*b* ends further than the virgin contacts 20 in the longitudinal direction of the contact sleeve 3. This means that the area of the rounded top 17 will have a first contact with the live contacts 19*b* at a distance from the virgin contacts 20 fully assured that an initial surge of high current would disrupt the plating of the end of the virgin contacts 20. The figure shows a not fully plugged state wherein the live contacts 19*b* and the virgin contacts 20 are spring loaded for making a contact with the corresponding mating pin 15.

OPERATION

When service personnel is going to plug the power connector, comprising a contact sleeve according to invention, to a for example a circuit card, they do not have to switch off the power circuit.

The ends of the three more inwardly bent contact beams, in this application also called live contacts, will uptake an initial surge of high current, when the service personnel is plugging the power terminnal, which was the intention of the inventor of this invention. Subsequently the contact sleeve can be mounted in a housing forming a power terminal.

When the mating pin is fully plugged in the contact sleeve, that is in a position for operation, the less inwardly bent three contact beams, in this application called virgin contacts, provide the contact function together with the other three live contacts.

Even though the contact capacity for electrical communication of the live contacts is reduced, the virgin contacts can provide means for electrical communication without any adulterations. Documentary analysis shows that even with two fully functioning virgin contacts, the electrical communication will be satisfactory.

When the plating at the end of the live contacts has been disrupted or the contact sleeve material itself is damaged, the damaged area will not have an effect on the mating pin in a plugged state or during the mating process. This is provided by means of the bevels of the live contacts, which bevels disrupted due to the inwardly bent position of the live contact, are in a more outer position than the surface of the mating pin during the mating process.

What is claimed is:

1. A contact sleeve (3) comprising a first end (6) for electrical communication with a conductor means (7), a fastening portion (9) at a central part (11) of said contact sleeve (3) and a second end (12) comprising a plurality of contact beams (13) with inner contact surfaces (14) projecting longitudinally from said central part (11) arranged generally cylindrically around a longitudinal axis (A—A) of said contact sleeve (3) adapted for electrical communication with a corresponding mating pin (15) provided with a rounded top (17), characterized in that said plurality of contact beams (13) comprises at least three first contact beams (19*a*, 19*b*) and at least one second contact beam (20) being inwardly bent in direction to said axis (A—A) of said contact sleeve (3), said at least three first contact beams (19*a*, 19*b*) relative to said at least one second contact beam (20) are more inwardly bent for making a first electrical contact with said corresponding mating pin (15) at the beginning of a mating cycle and said at least one second contact beam (20) makes a contact with said mating pin (15) after that said at least three first contact beams (19*a,* 19*b*) are in contact with said mating pin (15).

2. A contact sleeve according to claim 1, wherein said at least three first contact beams (19*a*) and said at least one second contact beam (20) have essentially the same length.

3. A contact sleeve according to claim 1, wherein said at least three first contact beams (19*b*) ends further than said at least one second contact beam (20) in the longitudinal direction of said contact sleeve (3) for making a first electrical contact with said corresponding mating pin (15) at the beginning of the mating cycle.

4. A contact sleeve according to claim 1, wherein said at least three first contact beams (19*a,* 19*b*) are equally disposed around said axis (A—A).

5. A contact sleeve according to claim 1, wherein said at least three first contact beams (19*a,* 19*b*) and said at least one second contact beam (20) in a plugged state are spring-loaded for making a contact with said corresponding mating pin (15).

6. A contact sleeve according to claim 1, wherein said contact beams (13) each comprises a bevel (21) for uptaking said rounded top (17) of said mating pin (15) at the beginning of the mating cycle.

7. A contact sleeve according to claim 1, wherein said at least three first contact beams (19*a,* 19*b*) each are made more narrow than said at least one second contact beam (20) for making a lesser spring-load on said pin (15).

8. A contact sleeve according to claim 1, wherein said central part (11) is provided with a bore (30) having an axis which corresponds with said axis (A—A) of said contact sleeve (3), said bore (30) has a further extension than said inner contact surfaces (14) of said plurality of contact beams (13) equivalent to a portion of said top (17) of said mating pin (15).

9. A contact sleeve according to claim 1, wherein three second contact beams (20) are arranged at said contact sleeve (3).

10. A contact sleeve according to claim 1, wherein a chamfering (22) is provided at the central part (11) for preventing the contact sleeve to rotate together with the conductor means (7) in a housing (4) comprising a partition (23).

* * * * *